US011484115B2

(12) United States Patent
Orona

(10) Patent No.: US 11,484,115 B2
(45) Date of Patent: Nov. 1, 2022

(54) DEPLOYABLE STAND ASSEMBLIES WITH FOLDING HINGES AND RELATED METHODS

(71) Applicant: Stephen Ross Orona, Torrence, CA (US)

(72) Inventor: Stephen Ross Orona, Torrence, CA (US)

( * ) Notice: Subject to any disclaimer, the term of this patent is extended or adjusted under 35 U.S.C. 154(b) by 0 days.

(21) Appl. No.: 16/657,064

(22) Filed: Oct. 18, 2019

(65) Prior Publication Data

US 2020/0121074 A1 Apr. 23, 2020

Related U.S. Application Data

(60) Provisional application No. 62/749,502, filed on Oct. 23, 2018.

(51) Int. Cl.
*A47B 23/04* (2006.01)

(52) U.S. Cl.
CPC ..... *A47B 23/043* (2013.01)

(58) Field of Classification Search
CPC .... A47B 23/043; A47B 23/044; A47B 23/042
USPC ..... 248/459, 460, 463, 462, 447, 448, 450, 248/454, 455, 456, 457; 281/31, 33
See application file for complete search history.

(56) References Cited

U.S. PATENT DOCUMENTS

| | | | | | |
|---|---|---|---|---|---|
| 337,544 | A * | 3/1886 | Yaggy | A47B 23/042 | 248/460 |
| 666,941 | A * | 1/1901 | Streit | A47B 23/042 | 248/459 |
| 1,053,112 | A * | 2/1913 | Scott | A47B 23/043 | 248/456 |
| 1,486,652 | A * | 3/1924 | Froelich | A47G 1/141 | 40/750 |
| 1,957,039 | A * | 5/1934 | Buenger | B42F 13/402 | 281/33 |
| 3,128,108 | A * | 4/1964 | Finch | B42D 3/18 | 281/33 |
| 3,367,679 | A * | 2/1968 | Slanhoff | B42D 3/126 | 281/33 |
| 3,708,184 | A * | 1/1973 | Slanhoff | B42D 3/126 | 281/33 |
| 3,981,522 | A * | 9/1976 | Bloom | B42D 3/126 | 281/34 |
| 4,679,757 | A * | 7/1987 | Mussari | A47B 23/043 | 248/165 |

(Continued)

FOREIGN PATENT DOCUMENTS

| | | | | |
|---|---|---|---|---|
| GB | 190603882 A * | 8/1906 | | |
| GB | 191219935 A * | 9/1913 | | A47B 23/043 |

(Continued)

*Primary Examiner* — Kimberly T Wood
(74) *Attorney, Agent, or Firm* — KOS IP Law LLP

(57) ABSTRACT

Deployable stands are described for holding a book at an angle relative to a tabletop. The deployable stand can have a cover panel with a deployed pocket and a folding assembly with three panels. The three panels can be rotatably hinged in series to the cover panel. The deployed pocket can be for fitment with the folding assembly to maintain a deployed position. The three panels can form a base for holding the book at an angle relative a tabletop in the deployed position.

21 Claims, 5 Drawing Sheets

(56) References Cited

U.S. PATENT DOCUMENTS

| | | | | | |
|---|---|---|---|---|---|
| 4,991,812 | A * | 2/1991 | MacEwan | A47B 19/08 | 248/174 |
| 5,149,047 | A * | 9/1992 | Tucker | A47B 23/044 | 248/174 |
| 5,253,840 | A * | 10/1993 | Sheremetta | A47B 23/043 | 248/452 |
| 6,213,439 | B1 * | 4/2001 | Giulie | A47B 97/04 | 248/459 |
| 6,305,652 | B1 * | 10/2001 | Borke | A47B 23/002 | 248/174 |
| 9,671,057 | B2 * | 6/2017 | Lin | H04M 1/04 | |
| 2004/0256535 | A1 * | 12/2004 | Desch | A47B 23/042 | 248/460 |
| 2005/0012016 | A1 * | 1/2005 | Teuscher | A47B 23/044 | 248/460 |
| 2006/0249646 | A1 * | 11/2006 | Al-Haleem | A47B 23/044 | 248/459 |

FOREIGN PATENT DOCUMENTS

| | | | | |
|---|---|---|---|---|
| KR | 2005035840 | A * | 3/2005 | |
| NL | 1021094 | C2 * | 8/2003 | A47B 23/043 |

* cited by examiner

DEPLOYABLE STAND ASSEMBLIES WITH FOLDING HINGES AND RELATED METHODS

FIELD OF ART

The current devices, systems, and methods relate to deployable stands for print media. In particular, the devices, systems, and methods relate to cover panels and deployable stands for print media with hinged panels foldable to form a stand for holding the print media upright on a tabletop.

BACKGROUND

Print media has been used for a variety of reasons, including for fixing works of art, recording history, spreading knowledge and information, etc. Historically, text has been printed in a variety of print media ranging from scrolls to magazines, booklets, and books. Generally, in regards to books, books are understood as comprising a number of pages of paper held by a binding to the front and back panels. In thick books, the front and back panels can also be connected by way of a spine panel.

Conventionally, readers of print media have laid books open on flat tabletop surfaces for reading of the print media. Some readers can use an angled lectern or easel when available, primarily in libraries or lecture halls. However, these are heavy and unsuitable for transportation.

SUMMARY

The present disclosure relates to a deployable stand for print media that can be attached to the print media or integrally formed with the print media, such as during a manufacturing binding step.

One or more embodiments of a deployable stand for print media can include a first cover panel and a second cover panel, the first cover panel coupled to the second cover panel.

One or more embodiments can include a first folding assembly including a first panel, a second panel, and a third panel, a first edge of the first panel of the first folding assembly hinged to the first cover panel, a second edge of the first panel of the first folding assembly hinged to a first edge of the second panel of the first folding assembly, and a second edge of the second panel of the first folding assembly hinged to a first edge of the third panel of the first folding assembly.

One or more embodiments can include a second folding assembly including a first panel, a second panel, and a third panel, a first edge of the first panel of the second folding assembly hinged to the second cover panel, a second edge of the first panel of the second folding assembly hinged to a first edge of the second panel of the second folding assembly, and a second edge of the second panel of the second folding assembly hinged to a first edge of the third panel of the second folding assembly.

One or more embodiments can include wherein each of the first folding assembly and the second folding assembly has a deployed position, the deployed position defined by the first panel positioned at an acute angle relative to the cover panel.

In some embodiments, the deployable stand can further include a spine panel between the first cover panel and the second cover panel.

In some embodiments, the deployable stand can further include wherein the first cover panel comprises a storage pocket having an opening facing the first folding assembly.

In some embodiments, the deployable stand can further include wherein the first folding assembly has a flat position with the first panel of the first folding assembly, the second panel of the first folding assembly, and the third panel of the first folding assembly being substantially co-planar.

In some embodiments, the deployable stand can further include wherein the third panel of the first folding assembly is received in the storage pocket in the flat position.

In some embodiments, the deployable stand can further include wherein the first cover panel comprises a deployed pocket having an opening facing the first folding assembly.

In some embodiments, the deployable stand can further include wherein the deployed pocket receives the third panel in the deployed position.

One or more embodiments of a deployable stand for print media can include a cover panel.

One or more embodiments of a deployable stand for print media can include a folding assembly rotatably hinged to the cover panel.

One or more embodiments of the folding assembly of a deployable stand for print media can include a first panel comprising a first edge and an opposed second edge, the first edge of the first panel hinged to the cover panel. One or more embodiments of the folding assembly of a deployable stand for print media can include a second panel comprising a first edge and an opposed second edge, the first edge of the second panel hinged to the second edge of the first panel. One or more embodiments of the folding assembly of a deployable stand for print media can include a third panel comprising a first edge, the first edge of the second panel hinged to the second edge of the second panel;

One or more embodiments of a deployable stand for print media can include wherein the folding assembly has a deployed position.

One or more embodiments of a deployable stand for print media can include wherein the deployed position is defined by the first panel positioned at an acute angle relative to the cover panel.

In some embodiments, the deployable stand can further include a deployed pocket having an opening facing the folding assembly.

In some embodiments, the deployable stand can further include wherein the deployed pocket receives the third panel in the deployed position.

In some embodiments, the deployable stand can further include wherein the folding assembly has a flat position, the flat position being when the first panel, the second panel, and the third panel are substantially co-planar.

With the traditional way of reading print media, readers have laid books and magazines, or soft paperbacks, open flat on tabletop surfaces for reading the print media. Print media can be in a variety of forms, including magazines, booklets, paperback books, and hard cover books, among others. For the purpose of simplification, the present disclosure uses books as the exemplary print media and in a generic sense to cover different types of print media for usage of the deployable stand. However, it is understood that the embodiments of the deployable stand can be used with other forms of print media.

The present disclosure is directed towards deployable stands for books with hinged panels foldable to form a stand for holding the book at an angle relative to a tabletop. Optional adjustment mechanisms can be provided to enable adjustment to the viewing angle. The features of the present deployable stand are not restrictive and do not prevent readers from continuing to read books by merely opening the book flat on a tabletop or other surfaces. However, the features incorporated herein provide for angling the book relative to the tabletop and allow the reader to more easily read the book while sitting upright and without needing to tilt the head down to the same extent as when not using any reading stand.

By positioning the book at an angle relative to the tabletop, the reader can more easily view the text of the book without having to hunch over or bend their neck downward as they would if the book was flat on the tabletop. When reading around a big table, the angled book also provides more privacy. In this way, the reader can be less likely to suffer fatigue from being hunched over and less likely to develop bad posture habits. Additionally, the ability to read the book while seated upright instead of hunching over the book can also provide for better lighting of the text of the book from an external lighting source instead of having the reader block the light while hunched over.

By attaching or integrally forming a deployable stand to a book, the reader does not have to carry a separate stand. Additionally, the deployable stand can take up minimal additional space.

Embodiments of the present application provide for a deployable stand, which can be attached to or integrally formed with a book such as during publication of the book, to allow for convenient transportation of one book.

With reference now to FIGS. 1 and 2, a deployable stand for holding a book at an angle in a pre-deployed state is shown. FIG. 1 illustrates a back view or back side of the deployable stand assembly of the present disclosure.

The deployable stand can include a first cover panel and a second cover panel, each sized and shaped to correspond to dimensions of a book, such as to the front and back covers or a book. In some examples, the first and second cover panels can be sized to operate with a range of book cover dimensions of a book.

The first cover panel and the second cover panel can have a joint or hinge at side edges of the first cover panel and the second cover panel, otherwise noted as between the first cover panel and the second panel.

The first cover panel and the second cover panel can be understood as symmetrically reflective about the joint, although specific features may be provided for one panel and not the other panel, such as pockets, art work, etc.

The first cover panel and the second cover panel can each be defined by a top edge an opposite bottom edge and two side edges. The top edges can be understood as corresponding to the top of an upright orientation or the text of the book, and the bottom edges can be understood as corresponding to the bottom of the book.

A width orientation of the components of the deployable stand can be understood as being from side edge to side edge, whereas a length orientation can be understood as being from the top edge to the bottom edge.

In one or more embodiments, the various panels of the deployable stand assembly can be made of a rigid or semi-rigid backing, such as cardboard as a structural material. Alternative structural materials can include plastic, metal, particle board or a composite. The various panels may be held together by a webbing material or cloth, as further discussed below.

Books can be printed in a variety of dimensions, including 5 inches width by 8 inches length, 8.5 inches width by 11 inches length, etc. Some hardcover books have front and back covers that are dimensionally oversized relative to the paper by about half an inch. For the purpose of simplification, the first and last pages of a book are used to represent the first and the last sheet of material of the book. As such, the first and last pages of the book can be the front and back cover of a hardcover book or a softcover book as would be understood.

The first cover panel and the second cover panel can each be rectangular in shape and dimensioned to have approximately the same width and length dimensions of the first and the last pages of the book.

In some embodiments, each of the width and the length dimensions of the first cover panel can be from approximately 80% to 120% of the respective dimension of the book. For example, the first cover panel and the second cover panel can have width and length dimensions ranging from 4 inches to 24 inches. More commonly, for example with textbooks, the width can likely be between 5 inches and 10 inches and the length can likely be between 8 inches and 12 inches. However, the first cover panel and the second cover panel can have different geometric shapes or different dimensions as may be desirable.

In some embodiments, the first cover panel and the second cover panel may be of a predetermined thickness to provide a desired rigidity or flexibility. For example, it may be desired that first cover panel and the second cover panel have minimal flexibility so as to prevent bending of the book. Alternatively, a thickness allowing for some flexibility while, maintaining sufficient rigidity for use as a stand, may be desirable for weight saving.

In some embodiments, a cloth, plastic, fabric or sheet material, can surround the structural material of the first cover panel and the second cover panel. The cloth, fabric, or sheet material may be considered a matrix that holds the structural materials, such as panels, together. In some examples, stitching, adhesive, bonding, welding, molding, or combinations thereof may be used to construct the matrix with the structural materials confined therein.

In one or more embodiments, the cloth can be sewn to contain the structural material. For example, the cloth can envelop the structural material of the first cover panel and the second cover panel, and stitching can be applied around all edges of the first cover panel and the second cover panel. Thus, the first cover panel and the second cover panel are fixed with cloth by the stitching, and the cloth itself can act as a living hinge for the joint.

In still other examples, the structural materials may be held by thermoplastic sheets and the edges of the thermoplastic sheets heat welded together to confine the structural materials therein and to act as living hinges to enable the structural materials to move relative to one another to deploy or collapse.

In some embodiments, the hinge of the joint can be a hinge formed by taping the adjacent panels, or can be the cloth material that interconnects adjacent structural materials. In one or more embodiments, for a separately formed and subsequently attached deployable stand assembly, the first cover panel and the second cover panel can be attached to the front and back covers of a book. In an example, the front and back covers and/or pages of the book can slide into inside pockets provided with the first cover panel and the second cover panel.

In some embodiments, the first cover panel and the second cover panel can each have an inside pocket to receive a respective portion of first and last pages of the book. Each inside pocket can have an opening with a length that runs 80-100% of the length of the side edge and can have a depth, or distance that is roughly 20% to 60% of the width of the cover panel. The opening of each pocket can be located inwardly of a side edge, between the side edge and the hinge. Each pocket is defined by a sleeve that overlies or overlaps the respective cover panel.

In some embodiments, a cloth surrounding or overlaid on the structural material of the first cover panel and the second cover panel can be sewn to define the inside pockets. The cloth can also be sewn to define storage pockets, and deployed pockets on a front side of the first cover panel and the second cover panel as described below with respect to FIG. 2. Functions of the various pockets are further discussed below.

The various pockets can be defined between the structural material and the cloth or fabric, or the cloth or fabric can be sewn in such a way to define a pocket. For example, a cloth or fabric provided on the front side of the deployable stand assembly can be folded over a side edge on the back side to define the pocket. Where the matrix for holding the various structural materials, for use to deploy the various panels, or for storage during the collapsed state of the stand is made from thermoplastic sheets, the pockets can be formed by laying a strip of thermoplastic sheet over larger sheets for forming the first and second cover panels and then welding or bonding the strip along three of the edges and leaving the fourth edge untouched to serve as an opening for the pocket. This process can repeat for each of the pockets. In still other examples, the pocket can be formed by folding over and extended portion of the primary sheets for forming the first and second cover panels and then welding three of the edges and leaving the fourth edge untouched to serve as the opening to the pocket.

In some embodiments, the inside pockets, the storage pockets, and the deployed pockets can each be defined by attaching a piece of the structural material to the first cover panel and the second cover panel by confining the piece of material along the edges, such as along the top edge, the bottom edge, and the side edge.

Alternatively, in some embodiments, the inside pockets, the storage pockets, and the deployed pockets can be separately formed from the remaining parts of the deployable stand and then subsequently attached to the first cover panel and the second cover panel.

It is understood that the pockets are not limited to just receiving the first and last pages, or front and back cover of a book, but can also receive pages adjacent the first and last pages. The inside pockets can be arranged vertically, or have edges that extend parallel to the side edges, and having openings facing inwardly to allow for outer portions of the first and last cover pages to be placed into the inside pockets. In this way, after placement of the first and last cover pages are inserted into the inside pockets, the remaining pages of the book are held between the first cover panel and the second cover panel, and accessible for reading by the reader.

Alternatively, instead of using inside pockets, other options can be used to secure the book to the deployable stand. For example, the first cover panel and the second cover panel can use elastic straps or bands instead of pockets. That is, ends of the elastic straps or bands can be attached to the first cover panel or the second cover panel and provide a retaining area between the elastic straps or bands and the first cover panel or the second cover panel. The retaining area can be similarly positioned as the inside pockets to receive the first and the last pages of the book. Alternatively, the first cover panel and the second cover panel can be attached by adhesive to the first and last cover pages. Still alternatively, rubber-band like elements can be used to strap around the first and second cover panels with the respective front and back pages.

FIG. 2 illustrates a front view of the deployable stand assembly of FIG. 1. The front side of the deployable stand assembly is configured to face away from the book when the stand assembly is assembled to the book. That is, when the book is closed and the deployable stand assembly is fitted to the book, the front side of the deployable stand assembly serves as the exterior of the book. As such, the deployable stand assembly also serves as a protective sleeve or shield for the book. As a protective sleeve or shield, the deployable stand assembly may also be provided with indicia and/or art work for information purposes or for aesthetic appeal. For example, the exposed exterior surfaces of the front side of the deployable stand assembly can be provided with prints, pictures, and/or artwork to reflect information of the book or contents held inside the covers or simply for aesthetics or artistic appeal.

For the most part, the first cover panel and the second cover panel can be understood as symmetrically reflective about the vertical joint. As such, the following explanation of a folding assembly for the first cover panel can be understood as being applicable to the second cover panel. The folding assembly of the first cover panel can include a first panel, a second panel, and a third panel. Each panel embodies structure that is movable relative to another panel and can define a boundary or perimeter. At the bottom edge of the first cover panel, a first edge of the first panel can be rotatably or pivotably hinged to the bottom edge of the first cover panel.

The second panel and the third panel can also be rotatably or pivotably hinged relative to the bottom edge of the first cover panel. In a particular example, the first cover panel, the first panel, the second panel, and the third panel are all hinged together in series. However, the sequence of pivoting or rotating of the panels are not dependent on how they are arranged. Some embodiments of the first panel, the second panel, and the third panel are each rectangular in shape. However, the first panel, the second panel, and the third panel can have different geometric shapes as may be desirable. Considerations can include space constraints on a table top for the first panel and the second panel. For example, the first panel and the second panel can have a parallelogram shape, a trapezoidal shape, or a stadium shape, which is a rectangle with semicircles at a pair of opposite sides. The length and width of each panel can also impact the angle that the deployable stand can sit at or be deployed at.

It is preferable that the lengths of the first panel, the second panel, and the third panel combined do not exceed, or at least not substantially exceed, the length of the page of book, so that they do not extend beyond, or excessively extend beyond, the dimensions of the book in the flat position, especially for a deployable stand assembly that is configured for use with a range of book sizes.

In one or more embodiments, the first panel, the second panel, and the third panel of the deployable stand assembly can be made of cardboard as a structural material of sufficient rigidity.

Alternative structural materials can include plastic or a composite. In some embodiments, the first panel, the second panel, and the third panel can be made of different materials than each other. Additionally, the first panel, the second panel, and the third panel can be made of different materials than the first cover panel and the second cover panel.

In some examples, metal materials or strips may be used as panels or to support panels made from a non-metallic material.

Additionally, a cloth, fabric or sheet material, can surround the structural material of the first panel, the second panel, and the third panel. In one or more embodiments, the cloth or fabric can be sewn to contain the structural material. In this way, the cloth or fabric itself can act as a living hinge for all of the necessary hinges of the joint, the first hinge, the second hinge, and the third hinge. Additionally, the cloth or fabric can be sewn to define the inside pockets, storage pockets, and deployed pockets. In some examples, the fabric can be a non-woven fabric and can be bonded or glued together instead of sewn together.

In some embodiments, the hinges of the joint, the first hinge, the second hinge, and the third hinge can be living hinges, hinges formed by taping adjacent panels, connected materials or strips of the materials of the matrix between the panels, or discrete hinges. The hinges of the joint, the first hinge, the second hinge, and the third hinge can be different from one another.

On the front side of the deployable stand assembly, the first cover panel can include a storage pocket and a deployed pocket. The storage pocket can be used when the folding assembly of the first panel, the second panel, and the third panel are in a flat position. In the flat position, the first panel, the second panel, and the third panel can be substantially co-planar. In the flat position, the first hinge can be folded such that the first panel is over the first cover panel. Accordingly, the first panel, the second panel, and the third panel can be substantially parallel to the first cover panel. At least the third panel can be inserted into the storage pocket to maintain the folding assembly in the flat position.

The deployed pocket can be used when the first panel, the second panel, and the third panel are in a deployed position, which is shown in FIG. 3. The deployed pocket can receive the third panel in the deployed position to maintain the deployed position of the folding assembly of the first panel, the second panel, and the third panel. As further illustrated in FIG. 3 below, in the deployed position, the first panel can be rotated about the first hinge to form an acute angle relative to the first cover panel. The second panel can be rotated about the second hinge to contact the first cover panel. As such, in the deployed position, the first panel, the second panel, and the first cover panel can define a base structure having a triangular transverse cross-section when viewed from a side of the deployable stand assembly.

The third panel can then be rotated about the third hinge and inserted in the deployed pocket. Accordingly, the third panel is substantially parallel to the first cover panel in the deployed position. The insertion of the third panel can then fix the position of the first panel and the second panel relative to the first cover panel. In this way, the deployable stand assembly can be placed on a tabletop surface with the first panel acting as the base in contact with the tabletop surface.

In some embodiments of the deployable stand assembly, multiple deployed pockets can be on the first cover panel at predetermined positions. The multiple deployed pockets can be set at different positions such that the fitment of the third panel into each of the multiple deployed pockets provides a different angle of inclination θ for the book in the deployed position. As such, the user can choose which of the multiple deployed pockets to place the third panel into in order to set a desired angle of inclination θ as understood in FIG. 3.

Additionally, it can be understood that the lengths of the first panel and the second panel can be set at predetermined lengths to determine the angle of inclination of the deployable stand assembly in the deployed position in consideration of the positioning of the deployed pocket. For given lengths of the first panel and the second panel, the closer the deployed pocket is to the bottom edge of the first cover panel, the higher the angle of inclination θ as understood in FIG. 3. Additionally, for a given first panel length and a given deployed pocket position, the longer the length of the second panel, the higher the angle of inclination θ as understood in FIG. 3.

Alternatively, instead of pockets, some embodiments can use magnets instead of at least of one the inside pocket, the storage pocket, and the deployed pocket. That is, a first magnet can be affixed to the first cover panel and a second magnet can be affixed to the third panel. The first magnet can be set at a desired position corresponding to where the third panel would be located in one of the inside pocket, the storage pocket, and the deployed pocket. Accordingly, the first panel, the second panel, and the third panel can be held in position by magnetic attraction between the first and the second magnet.

In embodiments, the various panels can be suitable for printed text or for embossed text. That is, the first cover panel, the second cover panel, the first panel, the second panel, and the third panel can each have text printed onto it. For example, the text can be customized by the reader, such as a monogram or other custom text. In some embodiments, the various panels can have the cover and inner jacket text of a specific book reproduced. In some embodiments, the text can be printed in such a way that it can be readable in both the flat position and the deployed position. Additionally, there can be a peek-a-boo effect in the deployed position, where text on the front side of the cover panel that would otherwise be covered one of the second panel or third panel in the flat position can be visible.

In some embodiments, the deployable stand assembly can be used in the actual book binding process to form the first and last pages of the book. In such a case, it may not be necessary to have the inside pockets as the deployable stand assembly will be integrated into the book during binding.

Additionally, in embodiments where the deployable stand assembly can be used in the actual book binding process to form the first and last pages of the book, the storage pockets may be located on the back side of the deployable stand assembly. The first hinge may be rotatable towards both the back side and the front side of the deployable stand assembly. As such, the first panel, the second panel, and the third panel may be rotated so that they are stored in the flat position on the inside of the book. That is, the folding assembly that is the first panel, the second panel, and the third panel may have a flat position stored on the inside of the book, and the folding assembly may then be rotated outside of the book for the deployed position.

In some embodiments, the deployable stand assembly can be pre-formed for future usage in a book binding process such as cardboard article binding.

Alternatively, the panels can be hinged through the use of discrete hinges attached to the panels of the deployable stand assembly or living hinge designed into the panels.

FIG. 3 illustrates a front perspective view of an embodiment of a deployable stand assembly with the folding assembly in the deployed position. In the deployed positioned, the first panel, and the second panel can be rotated to form a triangular base with the first cover panel. The third panel, shown in hidden lines, can then be inserted into the deployed pocket to retain the position of the first panel and the second panel. As the second cover panel is symmetrically reflective of the first cover panel across the joint 300, it can be similarly understood.

In the deployed position, the deployable stand assembly can then be placed on a table top with the first panel serving as a base for the deployable stand assembly. Based on the dimensioning of the first panel and the second panel as well as the placement of the deployed pocket, an angle of inclination θ of the deployable stand assembly can be set. As such, the reader can read a book as held by the deployable stand assembly at an inclined angle relative to the table top surface on which it is set.

With reference now to FIGS. 4 and 5, an alternative embodiment for a separately formed and subsequently attached deployable stand assembly for holding a book at an angle is shown. FIG. 4 illustrates a back view, or back side, of the deployable stand assembly. FIG. 5 illustrates a front view, or front side, of the deployable stand assembly.

Similar to the exemplary embodiment of FIG. 1, FIG. 4 shows a deployable stand assembly where the first cover panel and the second cover panel are coupled to one another by a spine panel. The first cover panel can be hinged to one edge of the spine panel, and the second cover panel can be hinged to an opposite edge of the spine panel.

The spine panel can be a predetermined width to accommodate a thickness of a book to be fitted to the deployable stand assembly. That is, the width of the spine panel can approximately have the same dimension as the thickness of the book. This can allow for the first cover panel and the second cover panel to properly fold towards one another when closing a book of significant thickness.

The spine panel can be made from a flexible structural material, such as a polymer, to allow for flexibility in accommodating books of different thicknesses. Alternatively, the spine panel can be made of a rigid or semi-rigid structural material, such as cardboard, plastic, metal, or a composite.

In some embodiments, the deployable stand assembly can be used in the actual book binding process to form the first and last pages of the book. In such a case, it may not be necessary to have the inside pockets as the deployable stand assembly will be integrated into the book during binding.

In some embodiments, the deployable stand assembly can be pre-formed for future usage in a book binding process. For example, in some embodiments, the deployable stand assembly can be manufactured with thermally activated adhesive on the spine for activation and usage in a book binding process such as a cardboard article process.

FIG. 6 illustrates a front view of an alternative embodiment of a deployable stand assembly. In one or more embodiments, the deployable stand assembly can have a single cover panel. In this way, the single cover panel can have the folding assembly of the first panel, the second panel, and the third panel. The cover panel can also have a storage pocket and a deployed pocket.

In some embodiments, the cover panel can be added as at least one of a front page and a back page to a stack of papers for book binding. As such, the cover panel can be added to papers prior to book binding and integrated with the book when used in processes such as thermal binding available in commercial printing stores. The cover panel can have the same width and length dimensions as the pages of the book to be bound. Alternatively, the cover panel can have width or length dimensions oversized relative to the pages of the book, ranging from 100% to 120% of the dimension of the page.

In some embodiments, the cover panel can include spiral binding holes. The spiral binding holes can be holes at a predetermined spacing for spiral binding coils. As such, the cover panel can be added to papers prior to book binding and integrated with the book in a spiral binding process. In embodiments utilizing spiral binding and the deployable stand on both the first and the last page of the book, it can be understood that the cover panels would have holes along opposite side edges so that the storage pocket and the deployed pocket would be oriented correctly towards an exterior of the book during binding as the first and last pages.

Alternatively, the cover panel can also be used for addition to a book. The cover panel could use an inside pocket or an elastic band to attach to a book in a similar manner as described above with respect to the embodiment of FIGS. 1-3.

Additionally, embodiments of the deployable stand assembly can be usable for applications other than print media including electronic devices. For example, the single cover panel embodiment of FIG. 6, can be adhesively glued to the back of an electronic device, such as a tablet or display monitor.

In such an application, the size of the stand assembly can be sized and shaped to fit with the tablet or display monitor and support the weight of the tablet or display monitor when in one of the deployed positions. Such embodiments for applications with tablets or display monitors can provide for easy and quick set-up for temporary events, such as pop-up events, where audio/visual components are required.

Methods of making the deployable stand assemblies and of using the deployable assemblies as described herein are within the scope of the present invention.

BRIEF DESCRIPTION OF THE DRAWINGS

These and other features and advantages of the present devices, systems, and methods will become appreciated as the same becomes better understood with reference to the specification, claims and appended drawings wherein:

DETAILED DESCRIPTION

Figure 1:
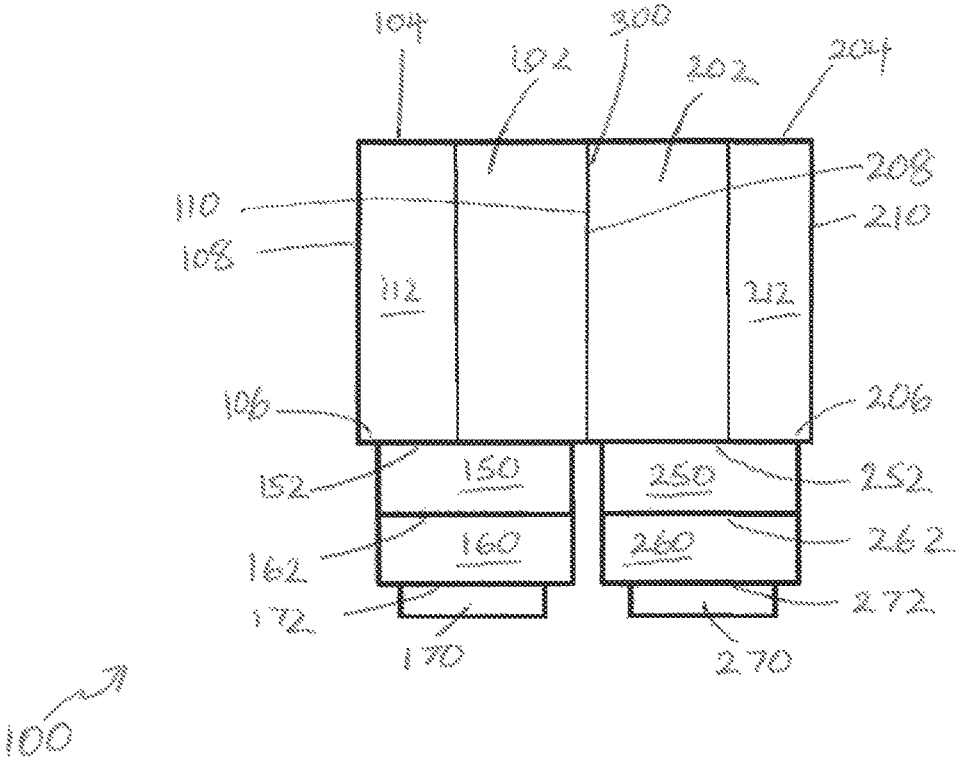
FIG. 1 shows a back view of an embodiment of a deployable stand assembly.

The detailed description set forth below in connection with the appended drawings is intended as a description of the presently preferred embodiments of deployable stands for print media with hinged panels provided in accordance with aspects of the present devices, systems, and methods and is not intended to represent the only forms in which the present devices, systems, and methods may be constructed or utilized. The description sets forth the features and the steps for constructing and using the embodiments of the present devices, systems, and methods in connection with the illustrated embodiments. It is to be understood, however, that the same or equivalent functions and structures may be accomplished by different embodiments that are also intended to be encompassed within the spirit and scope of the present disclosure. As denoted elsewhere herein, like element numbers are intended to indicate like or similar elements or features.

With the traditional way of reading print media, readers have laid books and magazines, or soft paperbacks, open flat on tabletop surfaces for reading the print media. Print media can be in a variety of forms, including magazines, booklets, paperback books, and hard cover books, among others. For the purpose of simplification, the present disclosure uses books as the exemplary print media and in a generic sense to cover different types of print media for usage of the deployable stand. However, it is understood that the embodiments of the deployable stand can be used with other forms of print media.

The present disclosure is directed towards deployable stands for books with hinged panels foldable to form a stand for holding the book at an angle relative to a tabletop. Optional adjustment mechanisms can be provided to enable adjustment to the viewing angle. The features of the present deployable stand are not restrictive and do not prevent readers from continuing to read books by merely opening the book flat on a tabletop or other surfaces. However, the features incorporated herein provide for angling the book relative to the tabletop and allow the reader to more easily read the book while sitting upright and without needing to tilt the head down to the same extent as when not using any reading stand.

By positioning the book at an angle relative to the tabletop, the reader can more easily view the text of the book without having to hunch over or bend their neck downward as they would if the book was flat on the tabletop. When reading around a big table, the angled book also provides more privacy. In this way, the reader can be less likely to suffer fatigue from being hunched over and less likely to develop bad posture habits. Additionally, the ability to read the book while seated upright instead of hunching over the book can also provide for better lighting of the text of the book from an external lighting source instead of having the reader block the light while hunched over.

By attaching or integrally forming a deployable stand to a book, the reader does not have to carry a separate stand. Additionally, the deployable stand can take up minimal additional space.

Embodiments of the present application provide for a deployable stand, which can be attached to or integrally formed with a book such as during publication of the book, to allow for convenient transportation of one book.

Figure 2:
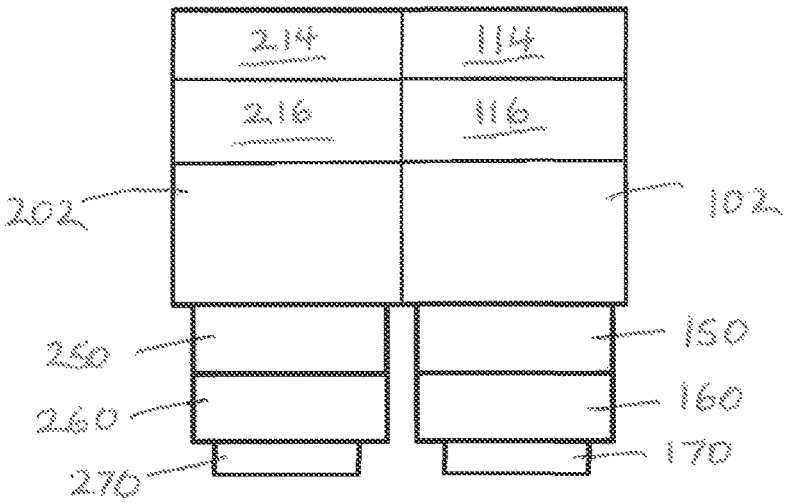
FIG. 2 shows a front view of an embodiment of a deployable stand assembly.

With reference now to FIGS. 1 and 2, a deployable stand for holding a book at an angle in a pre-deployed state is shown. FIG. 1 illustrates a back view or back side of the deployable stand assembly 100 of the present disclosure. The deployable stand 100 can include a first cover panel 102 and a second cover panel 202, each sized and shaped to correspond to dimensions of a book, such as to the front and back covers or a book. In some examples, the first and second cover panels 102, 202 can be sized to operate with a range of book cover dimensions of a book. The first cover panel 102 and the second cover panel 202 can have a joint or hinge 300 at side edges of the first cover panel 102 and the second cover panel 202, otherwise noted as between the first cover panel and the second panel.

The first cover panel 102 and the second cover panel 202 can be understood as symmetrically reflective about the joint 300, although specific features may be provided for one panel and not the other panel, such as pockets, art work, etc. The first cover panel 102 and the second cover panel 202 can each be defined by a top edge 104, 204 an opposite bottom edge 106, 206 and two side edges 108, 110, 208, 210. The top edges 104, 204 can be understood as corresponding to the top of an upright orientation or the text of the book, and the bottom edges 106, 206 can be understood as corresponding to the bottom of the book. A width orientation of the components of the deployable stand 100 can be understood as being from side edge to side edge, whereas a length orientation can be understood as being from the top edge to the bottom edge.

In one or more embodiments, the various panels of the deployable stand assembly can be made of a rigid or semi-rigid backing, such as cardboard as a structural material. Alternative structural materials can include plastic, metal, particle board or a composite. The various panels may be held together by a webbing material or cloth, as further discussed below.

Books can be printed in a variety of dimensions, including 5 inches width by 8 inches length, 8.5 inches width by 11 inches length, etc. Some hardcover books have front and back covers that are dimensionally oversized relative to the paper by about half an inch. For the purpose of simplification, the first and last pages of a book are used to represent the first and the last sheet of material of the book. As such, the first and last pages of the book can be the front and back cover of a hardcover book or a softcover book as would be understood.

The first cover panel 102 and the second cover panel 202 can each be rectangular in shape and dimensioned to have approximately the same width and length dimensions of the first and the last pages of the book. In some embodiments, each of the width and the length dimensions of the first cover panel 102 can be from approximately 80% to 120% of the respective dimension of the book. For example, the first cover panel 102 and the second cover panel 202 can have width and length dimensions ranging from 4 inches to 24 inches. More commonly, for example with textbooks, the width can likely be between 5 inches and 10 inches and the length can likely be between 8 inches and 12 inches. However, the first cover panel 102 and the second cover panel 202 can have different geometric shapes or different dimensions as may be desirable. In some embodiments, the first cover panel 102 and the second cover panel 202 may be of a predetermined thickness to provide a desired rigidity or flexibility. For example, it may be desired that first cover panel 102 and the second cover panel 202 have minimal flexibility so as to prevent bending of the book. Alternatively, a thickness allowing for some flexibility while, maintaining sufficient rigidity for use as a stand, may be desirable for weight saving.

In some embodiments, a cloth, plastic, fabric or sheet material, can surround the structural material of the first cover panel 102 and the second cover panel 202. The cloth, fabric, or sheet material may be considered a matrix that holds the structural materials, such as panels, together. In some examples, stitching, adhesive, bonding, welding, molding, or combinations thereof may be used to construct the matrix with the structural materials confined therein. In one or more embodiments, the cloth can be sewn to contain the structural material. For example, the cloth can envelop the structural material of the first cover panel 102 and the second cover panel 202, and stitching can be applied around all edges of the first cover panel 102 and the second cover panel 202. Thus, the first cover panel 102 and the second cover panel 202 are fixed with cloth by the stitching, and the cloth itself can act as a living hinge for the joint 300. In still other examples, the structural materials may be held by thermoplastic sheets and the edges of the thermoplastic sheets heat welded together to confine the structural materials therein and to act as living hinges to enable the structural materials to move relative to one another to deploy or collapse. In some embodiments, the hinge of the joint 300 can be a hinge formed by taping the adjacent panels, or can be the cloth material that interconnects adjacent structural materials. In one or more embodiments, for a separately formed and subsequently attached deployable stand assembly 100, the first cover panel 102 and the second cover panel 202 can be attached to the front and back covers of a book. In an example, the front and back covers and/or pages of the book can slide into inside pockets 112, 212 provided with the first cover panel 102 and the second cover panel 202. In some embodiments, the first cover panel 102 and the second cover panel 202 can each have an inside pocket 112, 212 to receive a respective portion of first and last pages of the book. Each inside pocket 112, 212 can have an opening with a length that runs 80-100% of the length of the side edge 108, 210 and can have a depth, or distance that is roughly 20% to 60% of the width of the cover panel 112, 212. The opening of each pocket can be located inwardly of a side edge 108, 210, between the side edge and the hinge 300. Each pocket is defined by a sleeve that overlies or overlaps the respective cover panel.

In some embodiments, a cloth surrounding or overlaid on the structural material of the first cover panel 102 and the second cover panel 202 can be sewn to define the inside pockets 112, 212. The cloth can also be sewn to define storage pockets 114, 214, and deployed pockets 116, 216 on a front side of the first cover panel 102 and the second cover panel 202 as described below with respect to FIG. 2. Functions of the various pockets are further discussed below.

The various pockets can be defined between the structural material and the cloth or fabric, or the cloth or fabric can be sewn in such a way to define a pocket. For example, a cloth or fabric provided on the front side of the deployable stand assembly 100 can be folded over a side edge 108, 210 on the back side to define the pocket. Where the matrix for holding the various structural materials, for use to deploy the various panels, or for storage during the collapsed state of the stand is made from thermoplastic sheets, the pockets can be formed by laying a strip of thermoplastic sheet over larger sheets for forming the first and second cover panels and then welding or bonding the strip along three of the edges and leaving the fourth edge untouched to serve as an opening for the pocket. This process can repeat for each of the pockets. In still other examples, the pocket can be formed by folding over and extended portion of the primary sheets for forming the first and second cover panels and then welding three of the edges and leaving the fourth edge untouched to serve as the opening to the pocket.

In some embodiments, the inside pockets 112, 212, the storage pockets 114, 214, and the deployed pockets 116 can each be defined by attaching a piece of the structural material to the first cover panel 102 and the second cover panel 202 by confining the piece of material along the edges, such as along the top edge 104, 204, the bottom edge 106, 206, and the side edge 108, 210.

Alternatively, in some embodiments, the inside pockets 112, 212, the storage pockets 114, 214, and the deployed pockets 116 can be separately formed from the remaining parts of the deployable stand and then subsequently attached to the first cover panel 102 and the second cover panel 202.

It is understood that the pockets are not limited to just receiving the first and last pages, or front and back cover of a book, but can also receive pages adjacent the first and last pages. The inside pockets can be arranged vertically, or have edges that extend parallel to the side edges 108, 208, and having openings facing inwardly to allow for outer portions of the first and last cover pages to be placed into the inside pockets 112, 212. In this way, after placement of the first and last cover pages are inserted into the inside pockets 112, 212, the remaining pages of the book are held between the first cover panel 102 and the second cover panel 202, and accessible for reading by the reader.

Alternatively, instead of using inside pockets 112, 212, other options can be used to secure the book to the deployable stand 100. For example, the first cover panel 102 and the second cover panel 202 can use elastic straps or bands instead of pockets. That is, ends of the elastic straps or bands can be attached to the first cover panel 102 or the second cover panel 202 and provide a retaining area between the elastic straps or bands and the first cover panel 102 or the second cover panel 202. The retaining area can be similarly positioned as the inside pockets 112, 212 to receive the first and the last pages of the book. Alternatively, the first cover panel 102 and the second cover panel 202 can be attached by adhesive to the first and last cover pages. Still alternatively, rubber-band like elements can be used to strap around the first and second cover panels with the respective front and back pages.

FIG. 2 illustrates a front view of the deployable stand assembly 100 of FIG. 1. The front side of the deployable stand assembly 100 is configured to face away from the book when the stand assembly is assembled to the book. That is, when the book is closed and the deployable stand assembly 100 is fitted to the book, the front side of the deployable stand assembly 100 serves as the exterior of the book. As such, the deployable stand assembly 100 also serves as a protective sleeve or shield for the book. As a protective sleeve or shield, the deployable stand assembly may also be provided with indicia and/or art work for information purposes or for aesthetic appeal. For example, the exposed exterior surfaces of the front side of the deployable stand assembly can be provided with prints, pictures, and/or artwork to reflect information of the book or contents held inside the covers or simply for aesthetics or artistic appeal.

For the most part, the first cover panel and the second cover panel can be understood as symmetrically reflective about the vertical joint 300. As such, the following explanation of a folding assembly 320 for the first cover panel 102 can be understood as being applicable to the second cover panel. The folding assembly 320 of the first cover panel can include a first panel 150, a second panel 160, and a third panel 170. Each panel embodies structure that is movable relative to another panel and can define a boundary or perimeter. At the bottom edge 106 of the first cover panel 102, a first edge of the first panel 150 can be rotatably or pivotably hinged to the bottom edge 106 of the first cover panel 102.

The second panel 160 and the third panel 170 can also be rotatably or pivotably hinged relative to the bottom edge 106 of the first cover panel. In a particular example, the first cover panel 102, the first panel 150, the second panel 160, and the third panel 170 are all hinged together in series. However, the sequence of pivoting or rotating of the panels are not dependent on how they are arranged.

Some embodiments of the first panel 150, the second panel 160, and the third panel 170 are each rectangular in shape. However, the first panel 150, the second panel 160, and the third panel 170 can have different geometric shapes as may be desirable. Considerations can include space constraints on a table top for the first panel 150 and the second panel 160. For example, the first panel 150 and the second panel 160 can have a parallelogram shape, a trapezoidal shape, or a stadium shape, which is a rectangle with semicircles at a pair of opposite sides. The length and width of each panel can also impact the angle that the deployable stand can sit at or be deployed at.

It is preferable that the lengths of the first panel 150, the second panel 160, and the third panel 170 combined do not exceed, or at least not substantially exceed, the length of the page of book, so that they do not extend beyond, or excessively extend beyond, the dimensions of the book in the flat position, especially for a deployable stand assembly that is configured for use with a range of book sizes.

In one or more embodiments, the first panel 150, the second panel 160, and the third panel 170 of the deployable stand assembly 100 can be made of cardboard as a structural material of sufficient rigidity. Alternative structural materials can include plastic or a composite. In some embodiments, the first panel 150, the second panel 160, and the third panel 170 can be made of different materials than each other. Additionally, the first panel 150, the second panel 160, and the third panel 170 can be made of different materials than the first cover panel 102 and the second cover panel 202. In some examples, metal materials or strips may be used as panels or to support panels made from a non-metallic material.

Additionally, a cloth, fabric or sheet material, can surround the structural material of the first panel 150, the second panel 160, and the third panel 170. In one or more embodiments, the cloth or fabric can be sewn to contain the structural material. In this way, the cloth or fabric itself can act as a living hinge for all of the necessary hinges of the joint 300, the first hinge 152, 252, the second hinge 162, 262, and the third hinge 172, 272. Additionally, the cloth or fabric can be sewn to define the inside pockets 112, 212, storage pockets 114, 214, and deployed pockets 116, 216. In some examples, the fabric can be a non-woven fabric and can be bonded or glued together instead of sewn together.

In some embodiments, the hinges of the joint 300, the first hinge 152, 252, the second hinge 162, 262, and the third hinge 172, 272 can be living hinges, hinges formed by taping adjacent panels, connected materials or strips of the materials of the matrix between the panels, or discrete hinges. The hinges of the joint 300, the first hinge 152, 252, the second hinge 162, 262, and the third hinge 172, 272 can be different from one another.

On the front side of the deployable stand assembly 100, the first cover panel 102 can include a storage pocket 114 and a deployed pocket 116. The storage pocket can be used when the folding assembly of the first panel 150, the second panel 160, and the third panel 170 are in a flat position. In the flat position, the first panel 150, the second panel 160, and the third panel 170 can be substantially co-planar. In the flat position, the first hinge 152 can be folded such that the first panel 150 is over the first cover panel 102. Accordingly, the first panel 150, the second panel 160, and the third panel 170 can be substantially parallel to the first cover panel 102. At least the third panel 170 can be inserted into the storage pocket 114 to maintain the folding assembly in the flat position.

Figure 3:
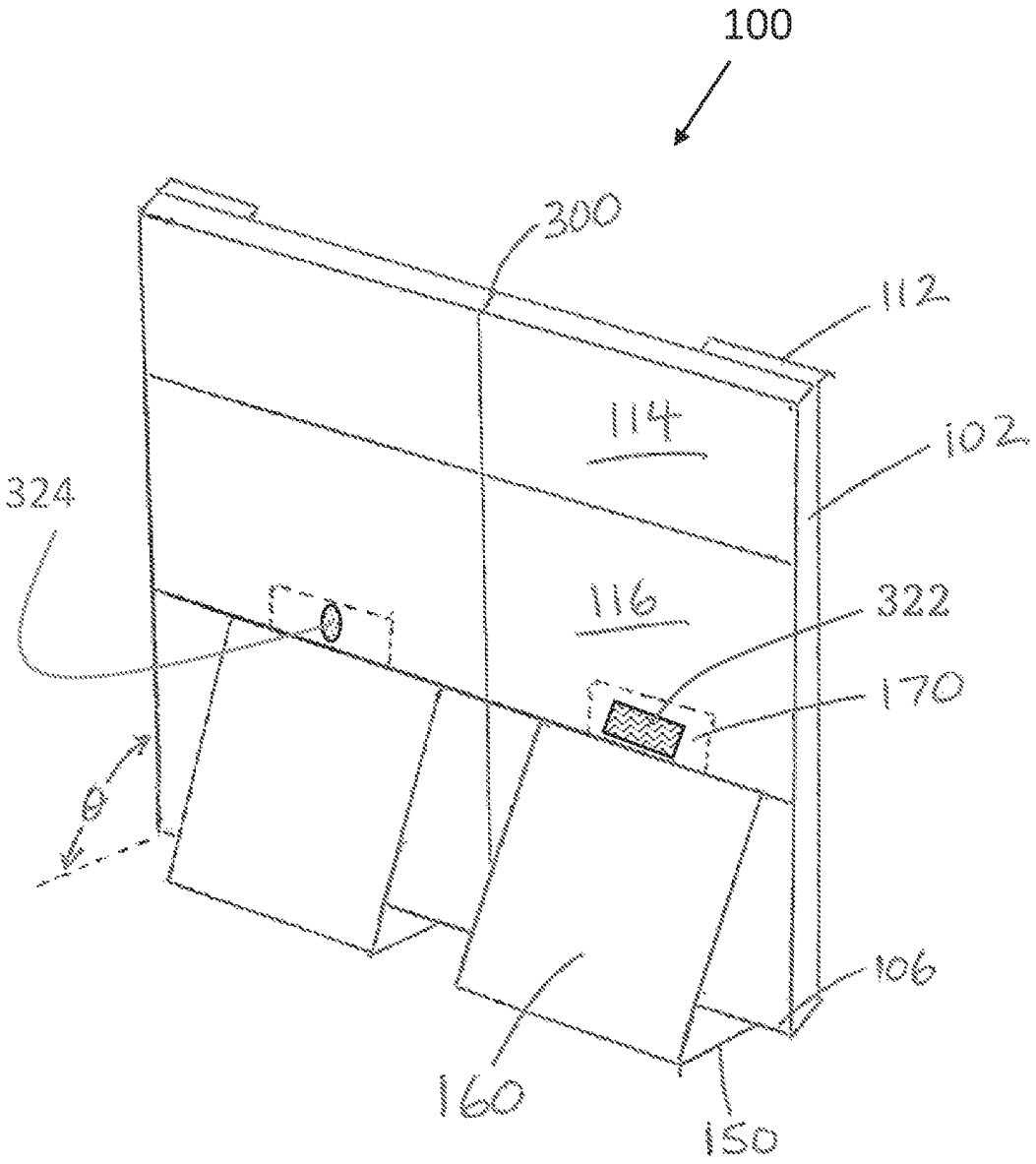
FIG. 3 shows a front perspective view of an embodiment of a deployable stand assembly with the folding assembly in a deployed position and FIG. 3A shows the deployable stand assembly in a flat position, with the third panel located in the storage pocket.

The deployed pocket 116 can be used when the first panel 150, the second panel 160, and the third panel 170 are in a deployed position, which is shown in FIG. 3. The deployed pocket 116 can receive the third panel 170 in the deployed position to maintain the deployed position of the folding assembly of the first panel 150, the second panel 160, and the third panel 170. As further illustrated in FIG. 3 below, in the deployed position, the first panel 150 can be rotated about the first hinge 152 to form an acute angle relative to the first cover panel. The second panel 160 can be rotated about the second hinge 160 to contact the first cover panel 102. As such, in the deployed position, the first panel 150, the second panel 160, and the first cover panel 102 can define a base structure having a triangular transverse cross-section when viewed from a side of the deployable stand assembly.

The third panel 170 can then be rotated about the third hinge and inserted in the deployed pocket 116. Accordingly, the third panel 170 is substantially parallel to the first cover panel 102 in the deployed position. The insertion of the third panel 170 can then fix the position of the first panel 150 and the second panel 160 relative to the first cover panel 102. In this way, the deployable stand assembly can be placed on a tabletop surface with the first panel 150 acting as the base in contact with the tabletop surface.

In some embodiments of the deployable stand assembly 100, multiple deployed pockets can be on the first cover panel 102 at predetermined positions. The multiple deployed pockets can be set at different positions such that the fitment of the third panel 170 into each of the multiple deployed pockets provides a different angle of inclination θ for the book in the deployed position. As such, the user can choose which of the multiple deployed pockets to place the third panel 170 into in order to set a desired angle of inclination θ as understood in FIG. 3.

In alternative embodiments, the deployable stand assembly 100 can utilize a Velcro and Velcro-type system with a hoop and loop fasteners or tapes. For example, one of the panels on one of the cover panels can incorporate one of the hook and loop fastener 322 or strip and the cover panel can incorporate the other one of the hook and loop fastener 322 or strip to enable deployment at a selected angle or angles. In still yet other examples, the deployable stand assembly 100 can employ magnets 324 and/or magnetically attractive metal sheets for use with magnets to permit deployment at a selected angle or angles.

Additionally, it can be understood that the lengths of the first panel 150 and the second panel 160 can be set at predetermined lengths to determine the angle of inclination of the deployable stand assembly in the deployed position in consideration of the positioning of the deployed pocket 116. For given lengths of the first panel 150 and the second panel 160, the closer the deployed pocket 116 is to the bottom edge 106 of the first cover panel 102, the higher the angle of inclination θ as understood in FIG. 3. Additionally, for a given first panel length 150 and a given deployed pocket position 116, the longer the length of the second panel 160, the higher the angle of inclination θ as understood in FIG. 3.

Alternatively, instead of pockets, some embodiments can use magnets instead of at least of one the inside pocket 112, the storage pocket 114, and the deployed pocket 116. That is, a first magnet can be affixed to the first cover panel 102 and a second magnet can be affixed to the third panel 170. The first magnet can be set at a desired position corresponding to where the third panel would be located in one of the inside pocket 112, the storage pocket 114, and the deployed pocket 116. Accordingly, the first panel 150, the second panel 160, and the third panel 170 can be held in position by magnetic attraction between the first and the second magnet.

In embodiments, the various panels can be suitable for printed text or for embossed text. That is, the first cover panel 102, the second cover panel 202, the first panel 150, 250, the second panel 160, 260, and the third panel 170, 270 can each have text printed onto it. For example, the text can be customized by the reader, such as a monogram or other custom text. In some embodiments, the various panels can have the cover and inner jacket text of a specific book reproduced. In some embodiments, the text can be printed in such a way that it can be readable in both the flat position and the deployed position. Additionally, there can be a peek-a-boo effect in the deployed position, where text on the front side of the cover panel 102, 202 that would otherwise be covered one of the second panel 160, 260 or third panel 170, 270 in the flat position can be visible.

In some embodiments, the deployable stand assembly 100 can be used in the actual book binding process to form the first and last pages of the book. In such a case, it may not be necessary to have the inside pockets 112 as the deployable stand assembly 100 will be integrated into the book during binding.

Additionally, in embodiments where the deployable stand assembly 100 can be used in the actual book binding process to form the first and last pages of the book, the storage pockets 114, 214 may be located on the back side of the deployable stand assembly 100. The first hinge 152, 252 may be rotatable towards both the back side and the front side of the deployable stand assembly 100. As such, the first panel 150, 250, the second panel 160, 260, and the third panel 170, 270 may be rotated so that they are stored in the flat position on the inside of the book. That is, the folding assembly that is the first panel 150, 250, the second panel 160, 260, and the third panel 170, 270 may have a flat position stored on the inside of the book, and the folding assembly may then be rotated outside of the book for the deployed position. For the embodiment with the panels folded to the inside of the two end covers, only a single pocket can be employed on the exterior side of each of the two end cover panels for deployment of the book stand.

In some embodiments, the deployable stand assembly 100 can be pre-formed for future usage in a book binding process such as cardboard article binding.

Alternatively, the panels can be hinged through the use of discrete hinges attached to the panels of the deployable stand assembly 100 or living hinge designed into the panels.

Figure 3A:
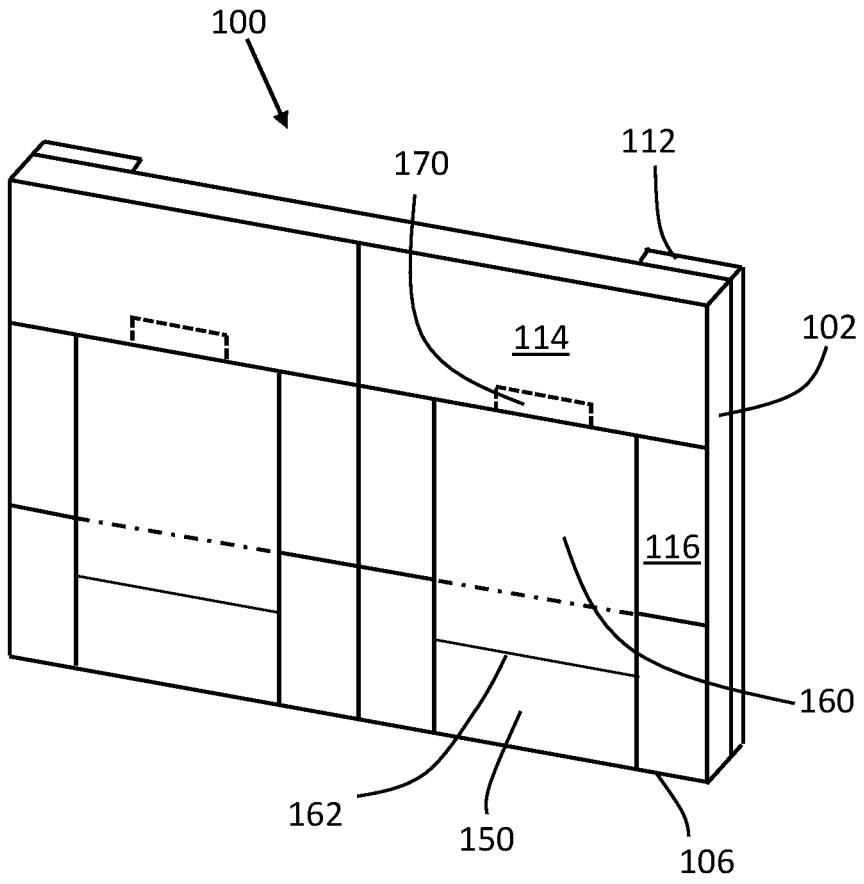

FIG. 3 illustrates a front perspective view of an embodiment of a deployable stand assembly with the folding assembly in the deployed position. In the deployed positioned, the first panel 150, and the second panel 160 can be rotated to form a triangular base with the first cover panel 102. The third panel 170, shown in hidden lines, can then be inserted into the deployed pocket 116 to retain the position of the first panel 150 and the second panel 160. As the second cover panel 202 is symmetrically reflective of the first cover panel across the joint 300, it can be similarly understood. FIG. 3A illustrates a front perspective view of the deployable stand assembly with the folding assembly in the flat position, in which the first panel 150, the second panel 160, and the third panel 170 are substantially co-planar and the third panel 170 is located in the storage pocket 114.

In the deployed position, the deployable stand assembly 100 can then be placed on a table top with the first panel 150 serving as a base for the deployable stand assembly 100.

Based on the dimensioning of the first panel 150 and the second panel 160 as well as the placement of the deployed pocket 116, an angle of inclination θ of the deployable stand assembly 100 can be set. As such, the reader can read a book as held by the deployable stand assembly 100 at an inclined angle relative to the table top surface on which it is set.

Figure 4:
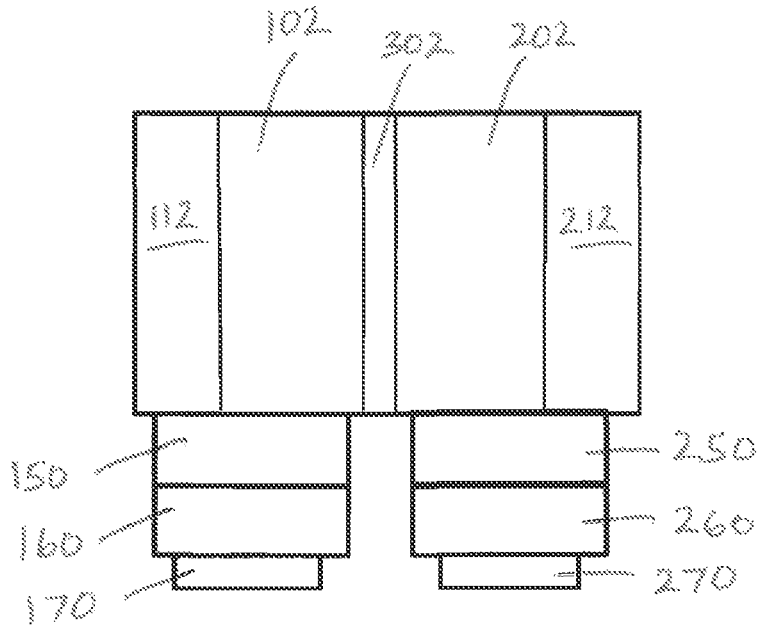
FIG. 4 shows a back view of an alternative embodiment of a deployable stand assembly having a central spine.
Figure 5:
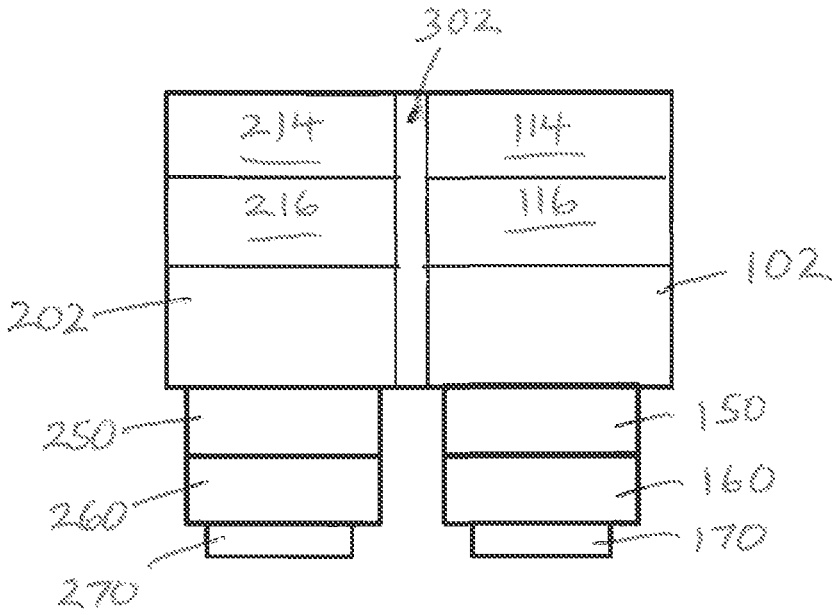
FIG. 5 shows a front view of the alternative embodiment of the deployable stand assembly.

With reference now to FIGS. 4 and 5, an alternative embodiment for a separately formed and subsequently attached deployable stand assembly 100 for holding a book at an angle is shown. FIG. 4 illustrates a back view, or back side, of the deployable stand assembly 100. FIG. 5 illustrates a front view, or front side, of the deployable stand assembly 100.

Similar to the exemplary embodiment of FIG. 1, FIG. 4 shows a deployable stand assembly 100 where the first cover panel 102 and the second cover panel 202 are coupled to one another by a spine panel 302. The first cover panel 102 can be hinged to one edge of the spine panel 302, and the second cover panel 202 can be hinged to an opposite edge of the spine panel 302.

The spine panel 302 can be a predetermined width to accommodate a thickness of a book to be fitted to the deployable stand assembly 100. That is, the width of the spine panel 302 can approximately have the same dimension as the thickness of the book. This can allow for the first cover panel 102 and the second cover panel 202 to properly fold towards one another when closing a book of significant thickness.

The spine panel 302 can be made from a flexible structural material, such as a polymer, to allow for flexibility in accommodating books of different thicknesses. Alternatively, the spine panel 302 can be made of a rigid or semi-rigid structural material, such as cardboard, plastic, metal, or a composite.

In some embodiments, the deployable stand assembly 100 can be used in the actual book binding process to form the first and last pages of the book. In such a case, it may not be necessary to have the inside pockets 112 as the deployable stand assembly 100 will be integrated into the book during binding.

In some embodiments, the deployable stand assembly 100 can be pre-formed for future usage in a book binding process. For example, in some embodiments, the deployable stand assembly 100 can be manufactured with thermally activated adhesive on the spine 302 for activation and usage in a book binding process such as a cardboard article process.

Figure 6:
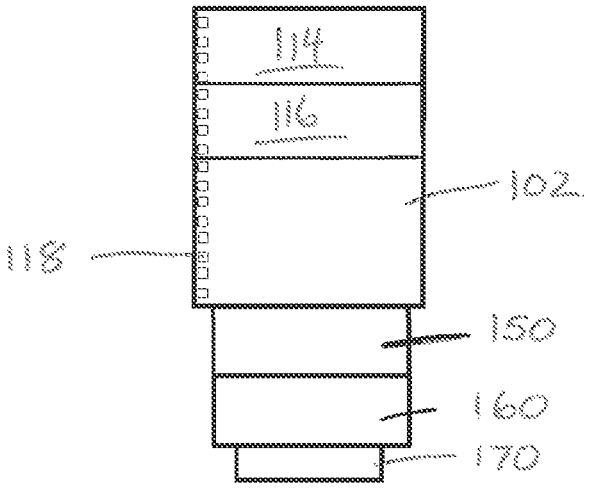
FIG. 6 shows a front view of an alternative embodiment of a deployable stand assembly.

FIG. 6 illustrates a front view of an alternative embodiment of a deployable stand assembly 100. In one or more embodiments, the deployable stand assembly 100 can have a single cover panel 102. In this way, the single cover panel 102 can have the folding assembly of the first panel 150, the second panel 160, and the third panel 170. The cover panel 102 can also have a storage pocket 114 and a deployed pocket 116.

In some embodiments, the cover panel 102 can be added as at least one of a front page and a back page to a stack of papers for book binding. As such, the cover panel 102 can be added to papers prior to book binding and integrated with the book when used in processes such as thermal binding available in commercial printing stores. The cover panel 102 can have the same width and length dimensions as the pages of the book to be bound. Alternatively, the cover panel 102 can have width or length dimensions oversized relative to the pages of the book, ranging from 100% to 120% of the dimension of the page.

In some embodiments, the cover panel 102 can include spiral binding holes 118. The spiral binding holes 118 can be holes at a predetermined spacing for spiral binding coils. As such, the cover panel 102 can be added to papers prior to book binding and integrated with the book in a spiral binding process. In embodiments utilizing spiral binding and the deployable stand on both the first and the last page of the book, it can be understood that the cover panels would have holes along opposite side edges so that the storage pocket 114 and the deployed pocket 116 would be oriented correctly towards an exterior of the book during binding as the first and last pages.

Alternatively, the cover panel 102 can also be used for addition to a book. The cover panel 102 could use an inside pocket or an elastic band to attach to a book in a similar manner as described above with respect to the embodiment of FIGS. 1-3.

Additionally, embodiments of the deployable stand assembly 100 can be usable for applications other than print media including electronic devices. For example, the single cover panel embodiment of FIG. 6, can be adhesively glued to the back of an electronic device, such as a tablet or display monitor.

In such an application, the size of the stand assembly 100 can be sized and shaped to fit with the tablet or display monitor and support the weight of the tablet or display monitor when in one of the deployed positions. Such embodiments for applications with tablets or display monitors can provide for easy and quick set-up for temporary events, such as pop-up events, where audio/visual components are required.

Methods of making the deployable stand assemblies and of using the deployable assemblies as described herein are within the scope of the present invention.

Although limited embodiments of the deployable stand assemblies and their applications have been specifically described and illustrated herein, including their components, many modifications and variations will be apparent to those skilled in the art. For example, the various features of the deployable stand assemblies may incorporate alternate materials, etc. Furthermore, it is understood and contemplated that features specifically discussed for one deployable stand assembly embodiment may be adopted for inclusion with another embodiment, provided the functions are compatible. Accordingly, it is to be understood that the deployable stand assemblies and their applications according to principles of the disclosed devices and methods may be embodied other than as specifically described herein. The disclosure is also defined in the following claims.

What is claimed is:

1. A deployable stand for print media comprising:

a first cover panel and a second cover panel, the first cover panel coupled to the second cover panel;

a first folding assembly comprising a first panel, a second panel, and a third panel, a first edge of the first panel of the first folding assembly hinged to the first cover panel, a second edge of the first panel of the first folding assembly hinged to a first edge of the second panel of the first folding assembly, and a second edge of the second panel of the first folding assembly hinged to a first edge of the third panel of the first folding assembly; and a second folding assembly spaced from the first folding assembly by a gap and comprising a first panel, a second panel, and a third panel, a first edge of the first panel of the second folding assembly hinged to the second cover panel, a second edge of the first panel of the second folding assembly hinged to a first edge of the second panel of the second folding assembly, and a second edge of the second panel of the second folding assembly hinged to a first edge of the third panel of the second folding assembly;

wherein the first cover panel comprises a first side for facing the print media and a second side opposing the first side;

wherein the first folding assembly has a deployed position, the deployed position is defined by the first panel of the first folding assembly being positioned at an acute angle relative to the first cover panel and first panel, the second panel, and the third panel of the first folding assembly are located on the second side of the first cover panel and the third panel is located in a deployed pocket; and wherein the first cover panel comprises a storage pocket having an opening on the second side and the third panel of the first folding assembly is located in the storage pocket in a flat position of the first folding assembly.

2. The deployable stand according to claim 1, wherein the first panel of the first folding assembly, the second panel of the first folding assembly, and the third panel of the first folding assembly being substantially co-planar in the flat position.

3. A deployable stand for print media comprising:

a first cover panel and a second cover panel, the first cover panel coupled to the second cover panel;

a first folding assembly comprising a first panel, a second panel, and a third panel, a first edge of the first panel of the first folding assembly hinged to the first cover panel, a second edge of the first panel of the first folding assembly hinged to a first edge of the second panel of the first folding assembly, and a second edge of the second panel of the first folding assembly hinged to a first edge of the third panel of the first folding assembly;

a second folding assembly spaced from the first folding assembly by a gap and comprising a first panel, a second panel, and a third panel, a first edge of the first panel of the second folding assembly hinged to the second cover panel, a second edge of the first panel of the second folding assembly hinged to a first edge of the second panel of the second folding assembly, and a second edge of the second panel of the second folding assembly hinged to a first edge of the third panel of the second folding assembly;

wherein the first cover panel comprises a first side for facing the print media, a second side opposing the first side and a storage pocket having an opening on the second side;

wherein the first folding assembly has a deployed position, the deployed position is defined by the first panel of the first folding assembly being positioned at an acute angle relative to the first cover panel and the first, second, and third panels of the first folding assembly being located on the second side;

wherein the first folding assembly has a flat position with the first panel of the first folding assembly, the second panel of the first folding assembly, and the third panel of the first folding assembly being substantially co-planar; and wherein the third panel of the first folding assembly is received in the storage pocket in the flat position.

4. The deployable stand according to claim 3, wherein the first cover panel comprises a deployed pocket having an opening on the second side and spaced from the storge pocket.

5. The deployable stand according to claim 4, wherein the third panel is located in the deployed pocket in the deployed position.

6. A deployable stand for print media comprising:

a cover panel having a bottom edge, a top edge, a first side for facing the print media, a second side opposite the first side, a deployed pocket having an opening on the second side, and a cover length measured between the bottom edge and the top edge; and a folding assembly rotatably hinged to the cover panel, the folding assembly comprising:

a first panel comprising a first edge and an opposed second edge, the first edge of the first panel hinged to the bottom edge of the cover panel;

a second panel comprising a first edge and an opposed second edge, the first edge of the second panel hinged to the second edge of the first panel; and a third panel comprising a first edge, the first edge of the third panel hinged to the second edge of the second panel;

wherein the folding assembly has a deployed position and a flat position;

wherein the deployed position is defined by the first panel being positioned at an acute angle relative to the cover panel, the third panel being located in the deployed pocket, and the first, second, and third panels being located on the second side of the cover panel;

wherein the flat position is defined by the first panel, the second panel, and the third panel being substantially co-planar and the third panel being spaced further away from the first panel than the second panel; and wherein the folding assembly has a folding assembly length in the flat position, and wherein the cover length is longer than the folding assembly length.

7. The deployable stand according to claim 6, further comprising a storage pocket having an opening on the second side of the cover panel, and wherein the storage pocket is located closer the top edge of the cover panel than the deployed pocket is to the top edge of the cover panel.

8. The deployable stand according to claim 6, wherein the third panel is located in the storage pocket in the flat position.

9. The deployable stand according to claim 1, wherein the second edge of the second panel is in contact with the first cover panel in the deployed position.

10. The deployable stand according to claim 9, wherein, for the first folding assembly, the third panel has a width and the second panel has a width, and wherein the width of the second panel is wider than the width of the third panel.

11. The deployable stand according to claim 1, wherein the first cover panel comprises the deployed pocket having an opening, and wherein the opening of the deployed pocket is located closer to the first panel than the opening of the storage pocket for receiving the third panel to the first panel.

12. The deployable stand according to claim 6, further comprising an inside pocket having an opening located on the first side of the cover panel, the inside pocket configured to receive the print media.

13. The deployable stand according to claim 12, wherein the opening of the inside pocket is angled to the opening of the storage pocket.

14. The deployable stand according to claim 6, wherein the cover panel is a first cover panel and the folding assembly is a first folding assembly, and further comprising a second cover panel attached to the first cover panel and a second folding assembly attached to a bottom edge of the second cover panel and spaced from the first folding assembly.

15. The deployable stand according to claim 1, further comprising an elastic strap or band attached to the first cover panel to secure at least part of the print media.

16. The deployable stand according to claim 1, further comprising an inside pocket located on the first side of the first cover panel, said inside pocket configured to receive at least part of the print media.

17. The deployable stand according to claim 3, wherein the first cover panel has a band attached to the first cover panel to secure at least part of a print media or an inside pocket on the first side of the first cover panel to receive at least part of the print media.

18. The deployable stand according to claim 3, wherein, for the first folding assembly, the third panel has a width and the second panel has a width, and wherein the width of the second panel is wider than the width of the third panel.

19. The deployable stand according to claim 6, wherein, the third panel has a width and the second panel has a width, and wherein the width of the second panel is wider than the width of the third panel.

20. The deployable stand according to claim 6, wherein the deployed pocket is a first deployed pocket and a second deployed pocket is located below, elevation-wise, the first deployed pocket.

21. The deployable stand according to claim 11, wherein the deployed pocket is a first deployed pocket and a second deployed pocket is located below the first deployed pocket.

* * * * *